US008883236B2

(12) United States Patent
Giusti

(10) Patent No.: US 8,883,236 B2
(45) Date of Patent: Nov. 11, 2014

(54) WRAPPING FOR FOOD PRODUCTS TO BE COOKED IN AN OVEN

(75) Inventor: Arturo Giusti, Bomarzo (IT)

(73) Assignee: Policarta S.r.l., Bassano In Teverina (VT) (IT)

( * ) Notice: Subject to any disclaimer, the term of this patent is extended or adjusted under 35 U.S.C. 154(b) by 1147 days.

(21) Appl. No.: 12/373,052

(22) PCT Filed: Jul. 10, 2007

(86) PCT No.: PCT/IB2007/052728

§ 371 (c)(1),
(2), (4) Date: Aug. 5, 2009

(87) PCT Pub. No.: WO2008/010147

PCT Pub. Date: Jan. 24, 2008

(65) Prior Publication Data

US 2009/0311388 A1 Dec. 17, 2009

(30) Foreign Application Priority Data

Jul. 13, 2006 (IT) ..... RM2006A0364

(51) Int. Cl.
*B65D 81/34* (2006.01)

(52) U.S. Cl.
CPC ..... *B65D 81/3461* (2013.01)
USPC ..... 426/113; 426/118; 426/234; 426/243; 426/412; 426/415; 229/87.06; 229/87.08; 428/34.3; 428/537.5

(58) Field of Classification Search
CPC ..... B65D 81/343; B65D 81/3446; B65D 81/3461
USPC ..... 426/113, 393, 166, 107, 118, 128, 410, 426/412, 415, 234, 241–243; 428/191, 428/34.2, 34.3, 211.1, 537.5; 229/87.06–87.11
See application file for complete search history.

(56) References Cited

U.S. PATENT DOCUMENTS

| | | | | |
|---|---|---|---|---|
| 4,045,262 | A * | 8/1977 | Enzinger et al. | 156/62.2 |
| 4,276,340 | A * | 6/1981 | de Leiris | 428/166 |
| 5,241,149 | A * | 8/1993 | Watanabe et al. | 219/725 |
| 5,698,290 | A * | 12/1997 | Fukushima et al. | 428/138 |
| 6,090,235 | A * | 7/2000 | Giusti | 156/259 |
| 6,187,396 | B1 * | 2/2001 | Moller | 428/34.3 |
| 7,727,604 | B2 * | 6/2010 | Schiffmann | 428/34.8 |
| 2005/0121444 | A1 | 6/2005 | Trochlil | |

(Continued)

FOREIGN PATENT DOCUMENTS

| | | |
|---|---|---|
| EP | 0 765 744 | 4/1997 |
| EP | 1541497 | 6/2005 |

(Continued)

OTHER PUBLICATIONS

FR 2841542 A1 EPO translation (2004).*

(Continued)

*Primary Examiner* — Drew Becker
(74) *Attorney, Agent, or Firm* — Steinfl & Bruno, LLP

(57) ABSTRACT

A packaged food product, comprising a wrapping (1) entirely made of coating-free transpiring paper material and a product (100) to be cooked or heated received therein, wherein the wrapping (1) itself is apt to be exposed to a heat source jointly to the product.

27 Claims, 2 Drawing Sheets

(56) References Cited

U.S. PATENT DOCUMENTS

| | | | | |
|---|---|---|---|---|
| 2006/0131303 | A1 | 6/2006 | Trochlil | |
| 2006/0276863 | A1 * | 12/2006 | Kumamoto et al. | 607/96 |
| 2007/0034202 | A1 * | 2/2007 | Pumphrey et al. | 126/263.01 |

FOREIGN PATENT DOCUMENTS

| | | |
|---|---|---|
| FR | 2841542 | 1/2004 |
| GB | 2211380 | 6/1989 |
| IT | 1275612 | 8/1996 |
| JP | 07232769 | 9/1995 |
| WO | 2005/036983 | 4/2005 |

OTHER PUBLICATIONS

Google Search results for "cellophane paper" run on Nov. 2, 2011.*

PCT International Search Report for PCT/IB2007/052728 filed on Jul. 10, 2007 in the name of Policarta S.R.L.

PCT International Preliminary Report on Patentability for PCT/IB2007/052728 filed on Jul. 10, 2007 in the name of Policarta S.R.L.

PCT Written Opinion for PCT/IB2007/052728 filed on Jul. 10, 2007 in the name of Policarta S.R.L. published on Jan. 13, 2009.

* cited by examiner

WRAPPING FOR FOOD PRODUCTS TO BE COOKED IN AN OVEN

CROSS REFERENCE TO RELATED APPLICATIONS

The present application is the U.S. national stage of International Application PCT/IB2007/052728 filed on Jul. 10, 2007 which, in turn, claims priority to Italian Application RM2006A000364, filed on Jul. 13, 2006.

FIELD

The present invention refers to a wrapping for food products, and in particular for products to be cooked or warmed up—typically in an oven—of the type consisting of an external wrapping that wraps the product itself, as well as to the product thus packaged and to a continuous web for use in the making of said wrapping.

BACKGROUND

The frenzied pace of modern life have led to the taking hold of ready dishes, at times frozen ones, requiring merely a warming up or a cooking by the end consumer.

Said ready dishes entail remarkable problems, still partially unsolved with concern to their packaging modes.

In particular, at the time of cooking or warming up the ready dish, the packaging has to be eliminated, in order to allow adequate gaseous exchange with the atmosphere. Hence, upon removing the packaging the product is transferred into a baking pan or other baking container. However, during these steps the product often loses its shape, breaks, or anyhow risks staining the consumer or the household appliance used. Moreover, the product may stick to the baking container, to the detriment of a full enjoyment of the product itself by the end consumer.

There are some wrappings that can be directly placed in an oven. In some cases, these have anyhow to be opened. Alternatively, they remain sealed, but require valves providing, with the increase of the internal pressure, an opening up in order to allow the outletting of the water vapour generated by cooking. Such a system is disclosed, e.g., in WO2005036983.

Other wrappings that can be directly placed in an oven with the related product often are quite complex to make, requiring the use of specific materials and/or of dedicated coatings, or once in the oven do not attain an optimal gaseous exchange with the environment, particularly with concern to $H_2O$ vapour.

In general terms, if the container remains closed $H_2O$ vapour tends, once emitted from the product, to remain trapped in the wrapping, "wetting" the product itself and compromising its taste, texture and organoleptic properties. Moreover, even if the container is opened, due to the presence just of the $H_2O$ vapour into the oven the result of the heating or of the cooking is not the optimal one.

SUMMARY

Hence, the technical problem set and solved by the present invention is to provide a wrapping for bakery food products allowing to overcome the drawbacks mentioned above with reference to the known art.

Such a problem is solved by a wrapping as claimed.

According to the same inventive concept, the present invention also refers to a continuous web as claimed and to a packaged product as claimed.

Preferred features of the present invention are present in the dependent claims thereof.

The present invention provides several relevant advantages. The main advantage lies in that the wrapping allows an optimal cooking or warming up of the product, optimizing in particular the exchange of $H_2O$ vapour with the cooking environment. In fact, as it will be better appreciated from the following detailed description, thanks also to the transpirability properties of the paper material forming the wrapping, there onsets a pressure regimen such that the pressure inside of the wrapping itself is higher than the external one, and this prevents the return of the emitted $H_2O$ vapour into the wrapping itself.

BRIEF DESCRIPTION OF THE DRAWINGS

Other advantages, features and the operation steps of the present invention will be made evident by the following detailed description of some embodiments thereof, given by way of example and not for limitative purposes. Reference will be made to the figures of the annexed drawings, wherein.

DETAILED DESCRIPTION

Figure 1:
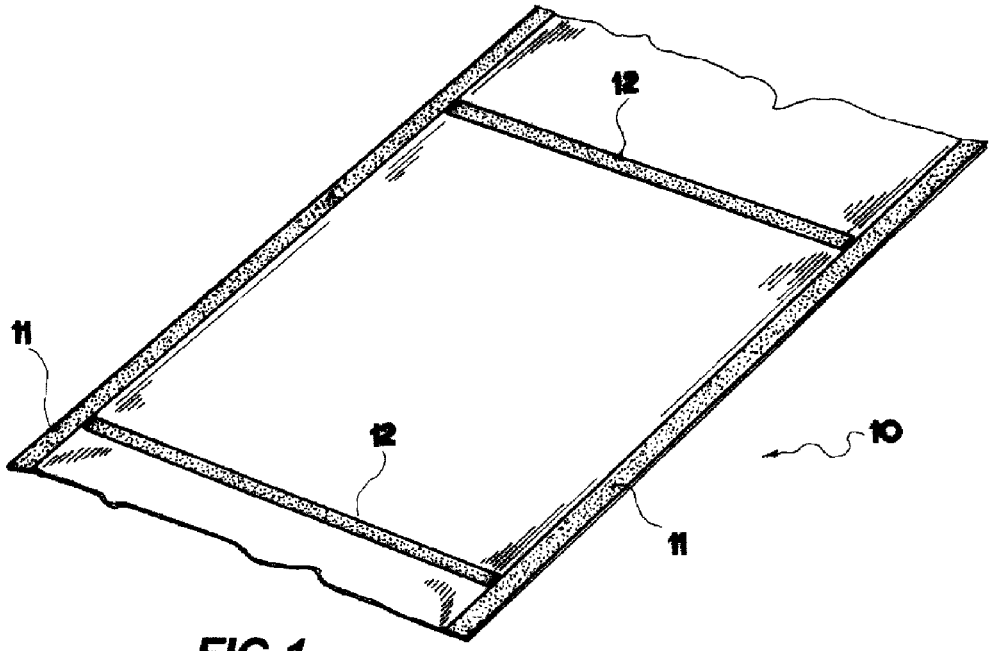
FIG. 1 shows a perspective view of a continuous web for making wrappings for food products according to an embodiment of the invention.

Referring initially to FIG. 1, a continuous web for making a wrapping of a food product according to a first embodiment of the invention is generally denoted by 10. The web 10 is made by using as base material a paper material.

Preferably, to better obtain the advantages of the present invention, such a paper material has substance number comprised in a range of 28-90 g/m$^2$ and preferably its permeability to $H_2O$ vapour is comprised in a range of from 4.000 to 15.000 cc H2O/mq/about 24 h.

The web 1 has longitudinal and transversal glue depositions, respectively denoted by 11 and 12, for closing the wrappings being formed. In particular, the longitudinal depositions 11 are obtained in correspondence of the two longitudinal edges of the web 10, whereas the transversal ones are obtained at regular intervals along the longitudinal development of the web 10 itself. Preferably, the transversal depositions 12 do not overlap to the longitudinal ones 11. In particular, such depositions may be made on privileged zones, as envisaged in Italian Pat. No. 1 275 612 to the same applicant, which is incorporated here by this reference.

However, the above-described longitudinal 11 and transversal 12 glue depositions may be applied onto the web 10 according to any known art. In particular, the depositions 11 and 12 may have a continuous development at least in correspondence of each of the wrappings being formed, as in the example depicted, or be applied according to any one discontinuous pattern. Likewise, the depositions 11 and 12 may be carried out according to any one application jig, e.g. be made of a plurality of glue threads or points.

Figure 2:
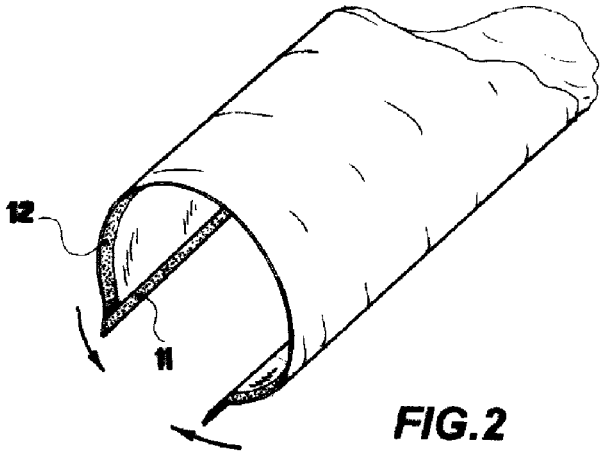
FIG. 2 shows a perspective view of the web of FIG. 1 during a step of folding for making a tubular structure.
Figure 3:
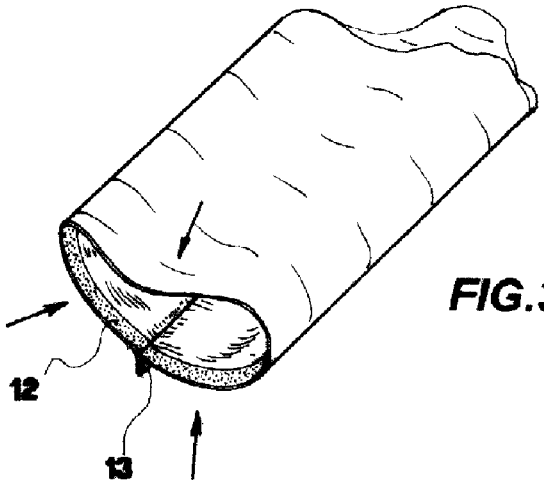
FIG. 3 shows a perspective view of the tubular structure of FIG. 2 during a step of transversal sealing of the wrappings being formed.

In FIGS. 2 and 3 there are shown two steps of forming the wrappings. As it is shown in said Figures, the longitudinal edges of the web 10, and therefore the related glue depositions 11, are overlapped so as to form a substantially tubular structure provided with a longitudinal closing flap 13 in correspondence of said overlapping of the glue depositions.

At this point, as it is shown in FIG. 3, the bakery food product (for simplicity's sake not shown in said Figure) is introduced in each wrapping being formed and opposite transversal portions of the latter bearing the transversal depositions 12 are pressed the one against the other to obtain the transversal closure of the wrapping itself, generating two transversal closing flaps 14.

Figure 4:
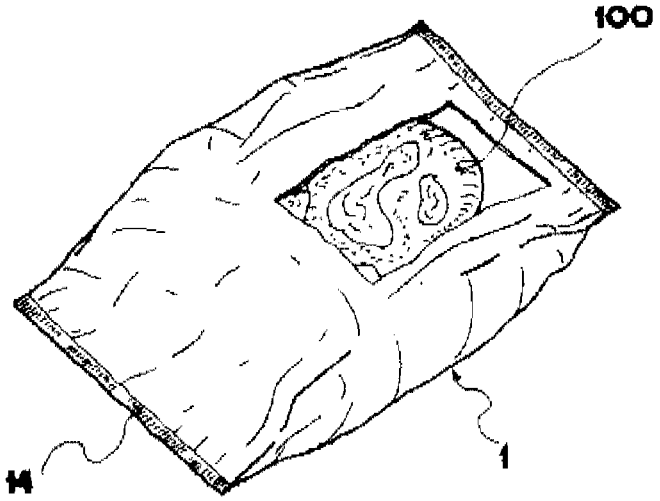
FIG. 4 shows a partially sectional perspective view of a bakery food product packaged in a wrapping obtained from the web of FIG. 1.

Then, the wrappings are separated by known cutting means. One of these wrappings is shown by way of example in FIG. 4 and therein the related wrapping, denoted by 1, is depicted as partially torn to show the product contained therein, the latter being denoted by 100.

As those steps of forming a wrapping containing a food product are substantially conventional and perfectly within the reach of a person skilled in the art, this aspect will no further be dwelt upon; it is understood that any other mode of obtaining the wrapping or any other shape or configuration thereof is compatible with the present invention.

As mentioned above, in the present embodiment it is provided that each wrapping 1 be formed and closed on a food product 100, e.g. a roll, plain or with a filling, in the same production cycle. Always in the present embodiment, it is also provided that the food product be packaged raw.

Figure 5:
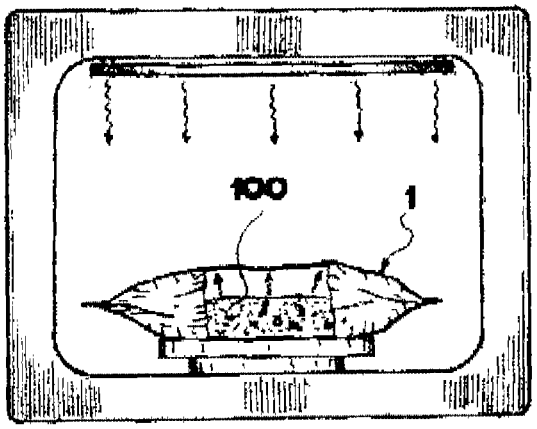
FIG. 5 shows a partially sectional front view of the packaged product of FIG. 4 during the cooking/warming up of the product itself in an oven.

As indicated in FIG. 5, the product 100, when it has to be consumed, may be subjected to a heat source while still packaged in the wrapping 1.

E.g., the packaged product may be placed in an electric oven. As it is schematically shown always in FIG. 5, the heat from the oven induces the outletting of $H_2O$ vapour from the product 100. The selection of the transpiring paper material for making the wrapping 1 and the fact that the wrapping itself for the remainder be completely sealed by the above-illustrated closing modes allows effective $H_2O$ vapour exchange from the inside to the outside of the wrapping and therefore a full and optimal cooking of the product 100. Concomitantly, between inside and outside of the wrapping there onsets a pressure regimen such that the internal pressure is higher than the external one by virtue of the higher internal temperature, with the advantages already illustrated.

Upon having completed the cooking the wrapping 1 is opened and disposed of, and the product 100 may be enjoyed warm.

Of course, the wrapping of the invention is suitable also to cooking or warming up in a microwave oven.

It will be understood that the present invention is susceptible of several embodiments alternative to the hereto-described ones, some of which are briefly illustrated hereinafter with reference to the sole aspects differentiating them from what has already been illustrated.

First of all, the wrapping, and therefore also the continuous web from which it can be formed, may have a composite structure, it being obtained, e.g., from the union of two base material, as in the case of wrappings formed by one or more strips of paper material alternate to one or more strips of transparent film or of wrappings having windows closed with a transparent material, as described, e.g., in the aforementioned Italian Pat. No 1 275 612 to the same applicant. In general, all wrappings made at least for the most part of coating-free transpiring paper material fall within the scope of the present invention.

Moreover, the food product may be any one bakery product or a more or less elaborate dish, to be cooked or merely warmed up under care of the end consumer. Furthermore, even though the invention has been described with reference to a packaging that is placed in an oven by the end consumer of the food product, alternative embodiments could envisage that the same advantages be exploited for the cooking or the warming up of the same product at an industrial level.

The present invention has hereto been described with reference to preferred embodiments thereof. It is understood that other embodiments might exist, all falling within the concept of the same invention, and all comprised within the protective scope of the claims hereinafter.

The invention claimed is:

1. A wrapping adapted to package a food product to be cooked or warmed up, the wrapping further adapted to be exposed to a heat source jointly to the product packaged therein to carry out said cooking or warming up, said wrapping comprising a coating-free transpiring non-transparent paper material, wherein said paper material exhibits $H_2O$ vapour permeability comprised in a range of 5,000-15,000 cc $H_2O/m^2$/about 24 h.

2. The wrapping according to claim 1, said wrapping being entirely made of said coating-free transpiring non-transparent paper material.

3. The wrapping according to claim 1, said wrapper comprising a window of substantially transparent material.

4. The wrapping according to claim 3, wherein said substantially transparent material is a transpiring material.

5. The wrapping according to claim 3, wherein said substantially transparent material exhibits $H_2O$ vapour permeability comprised in a range of 4,000 to 15,000 cc $H_2O/m^2$/about 24 h.

6. The wrapping according to claim 5, wherein said substantially transparent material exhibits $H_2O$ vapour permeability comprised in a range of 5,000 to 15,000 cc $H_2O/m^2$/about 24 h.

7. The wrapping according to claim 1, wherein said paper material has a substance number comprised in a range of 28-90 g/$m^2$.

8. The wrapping according to claim 1, wherein the cooking or warming up of the food is performed using an electric oven or a microwave oven.

9. A continuous web, the continuous web being used to form the wrappings of claim 1.

10. The continuous web according to claim 9, having glue depositions for closure of each wrapping.

11. The continuous web according to claim 10, wherein said glue depositions are arranged longitudinally and/or transversally on the web itself.

12. A packaged product comprising the wrapping according to claim 1 and a food product to be cooked or warmed up received therein.

13. A method of using a continuous web made of a coating-free transpiring paper material as a base material, the method comprising:

making with said continuous web wrappings for food products to be cooked or warmed up, wherein, said continuous web comprising a coating-free transpiring non-transparent paper material as a base material, each wrapping is exposed to a heat source jointly to the food product packaged therein to carry out said cooking or warming up, and said paper material exhibits $H_2O$ vapour permeability comprised in a range of 5,000-15,000 cc $H_2O/m^2$/about 24 h.

14. A method of packaging food products to be cooked or warmed up, comprising:

providing wrappings comprising a coating-free transpiring non-transparent paper material to be exposed to a heat source jointly to a product packaged therein to carry out said cooking or warming up, wherein said paper material exhibits $H_2O$ vapour permeability comprised in a range of 5,000-15,000 cc $H_2O/m^2$/about 24 h.

15. A wrapping for food products comprising:

a continuous web having at least two longitudinal edges and comprising:

a coating-free transpiring non-transparent paper material, said paper material exhibiting $H_2O$ vapour permeability comprised in a range of 5,000-15,000 cc $H_2O/m^2$/about 24 h; and longitudinal and transversal glue depositions, said longitudinal glue depositions being in correspondence with the longitudinal edges of the web and being configured so that the opposite longitudinal glue depositions can be joined to each other to make the web form a substantially tubular structure, and said transversal glue depositions being at regular intervals along a longitudinal development of the web and being configured so that each transversal glue deposition can be joined with itself to form a plurality of closed wrappings, said closed wrappings being configured so that they can be separated from each other to form individual separate closed wrappings.

16. The wrapping of claim 15, wherein the web further comprises a window of substantially transparent material.

17. An individual food wrapping obtained from the separation of the plurality of closed wrappings of claim 15.

18. A packaged food product comprising:

a continuous web having at least two longitudinal edges and comprising:

a coating-free transpiring non-transparent paper material, said paper material exhibiting $H_2O$ vapour permeability comprised in a range of 5,000-15,000 cc $H_2O/m^2$/about 24 h; and longitudinal and transversal glue depositions, said longitudinal glue depositions being in correspondence with the longitudinal edges of the web and being configured so that the opposite longitudinal glue depositions can be joined to each other to make the web form a substantially tubular structure, and said transversal glue depositions being at regular intervals along the longitudinal development of the web and being configured so that each transversal glue deposition can be joined with itself to form a plurality of closed wrappings, said closed wrappings being configured so that they can be separated from each other to form a plurality of individual separate closed wrappings;

and, a food product to be cooked or warmed up, said food product being located in at least one of the closed wrappings;

wherein the packaged food product is capable of being cooked or warmed up with the packaged food product being in a closed state.

19. The packaged food product of claim 18, wherein the web further comprises a window of substantially transparent material.

20. An individual packaged food product obtained from the separation of the plurality of closed wrappings containing a food product of claim 18.

21. The packaged food product of claim 18, wherein the transversal glue depositions do not overlap the longitudinal glue depositions.

22. The packaged food product of claim 18, wherein the longitudinal and transversal glue depositions are made on privileged zones.

23. The packaged food product of claim 18, wherein the longitudinal glue depositions are continuous in development along the edge of the web or are applied in a discontinuous pattern.

24. The packaged food product of claim 18, wherein the longitudinal and transversal glue depositions are made of a plurality of glue threads or points.

25. The packaged food product of claim 18, wherein the web is a composite structure, said composite structure being obtained from the union of at least two base materials.

26. The packaged food product of claim 18, wherein the food product is packaged raw.

27. The packaged food product of claim 18, wherein the cooking or warming is performed using an electric oven or a microwave oven.

* * * * *